US008356931B2

(12) United States Patent
Saleh et al.

(10) Patent No.: US 8,356,931 B2
(45) Date of Patent: Jan. 22, 2013

(54) ANGLED CROWN SETTING DEVICE

(75) Inventors: Muhammad Saleh, Woodbridge, CT (US); John Houlihan, Branford, CT (US); Mario Sabatini, Branford, CT (US); Paul Myott, Woodbridge, CT (US)

(73) Assignee: Bulltoro Watch Company, LLC, Woodbridge, CT (US)

( * ) Notice: Subject to any disclaimer, the term of this patent is extended or adjusted under 35 U.S.C. 154(b) by 223 days.

(21) Appl. No.: 12/903,807

(22) Filed: Oct. 13, 2010

(65) Prior Publication Data

US 2012/0092970 A1 Apr. 19, 2012

(51) Int. Cl.
*G04B 29/00* (2006.01)

(52) U.S. Cl. ..... 368/308

(58) Field of Classification Search ..... 368/306, 368/308, 319, 146, 288, 320, 185, 190, 321
See application file for complete search history.

(56) References Cited

U.S. PATENT DOCUMENTS 3,032,651 A * 5/1962 Gisiger-Stahli et al. ..... 455/269
3,999,298 A * 12/1976 Nishimura ..... 33/775
7,909,503 B2 * 3/2011 Hiranuma ..... 368/308

* cited by examiner

*Primary Examiner* — Edwin A. Leon
(74) *Attorney, Agent, or Firm* — Michael A. Blake

(57) ABSTRACT

A crown setting device for a timepiece comprising: a case; a bezel attached to the case; a setting stem in axially slideable communication with the case; a crown shaft, the crown shaft comprising: a first end; a second end; a first portion of the crown shaft abutting the first end; a second portion of the crown shaft abutting the second end; and wherein the first end is in fixed communication with the setting stem; a crown in fixed communication with the second end; and wherein the second portion is at an angle α with respect to the first portion, and wherein the angle α is between about 90° and about 175°.

5 Claims, 12 Drawing Sheets

ANGLED CROWN SETTING DEVICE

TECHNICAL FIELD

This invention relates generally to timepieces, and more particularly to an improved crown setting device for setting the time, setting an alarm, or setting the date of a timepiece.

BACKGROUND

Crown setting devices for timepieces are well known in the art. Usually, a timepiece movement, whether it be mechanical or a quartz analog type powered by an energy cell, has a separate internal set of gears connected between the hands and a special setting gear for rotating the timepiece hands to perform a setting function. The setting function, as is well known in the art, is generally carried out by manually operating a watch "crown" which protrudes from the side of the watch case. The crown is connected to an axially slideable, rotatable setting stem having a pinion on its inner end which engages the special setting gear when the crown is pulled out. The crown is knurled or corrugated with grooves to provide gripping teeth to assist in turning the crown. This can become a tedious process when the watch hands must be rotated through several revolutions and is also hard on the fingers when the crown is small in diameter.

Simple time-setting crowns having only two axial positions have evolved and been improved, wherein more than one crown may be used, one to set the time and another to set an alarm time. Also the setting crowns may be provided with more than two axial positions by the use of multiple detents, so as to engage a second internal set of gears to set calendar and/or day/date rings as well as the time of day.

As previously indicated, rotation of crown through many revolutions to set either the time or the alarm rings of the watch can be tiresome and hard on the fingers. In addition, if the crown is small in diameter, or closely set to the watch case, the crown may be difficult to access.

Thus there is a need for a crown setting device that overcomes the above listed and other disadvantages.

SUMMARY OF THE INVENTION

The disclosed invention relates to a crown setting device for a timepiece comprising: a case; a bezel attached to the case; a setting stem in axially slideable communication with the case; a crown shaft, the crown shaft comprising: a first end; a second end; a first portion of the crown shaft abutting the first end; a second portion of the crown shaft abutting the second end; and wherein the first end is in fixed communication with the setting stem; a crown in fixed communication with the second end; and wherein the second portion is at an angle $\alpha$ with respect to the first portion, and wherein the angle $\alpha$ is between about 90° and about 175°.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
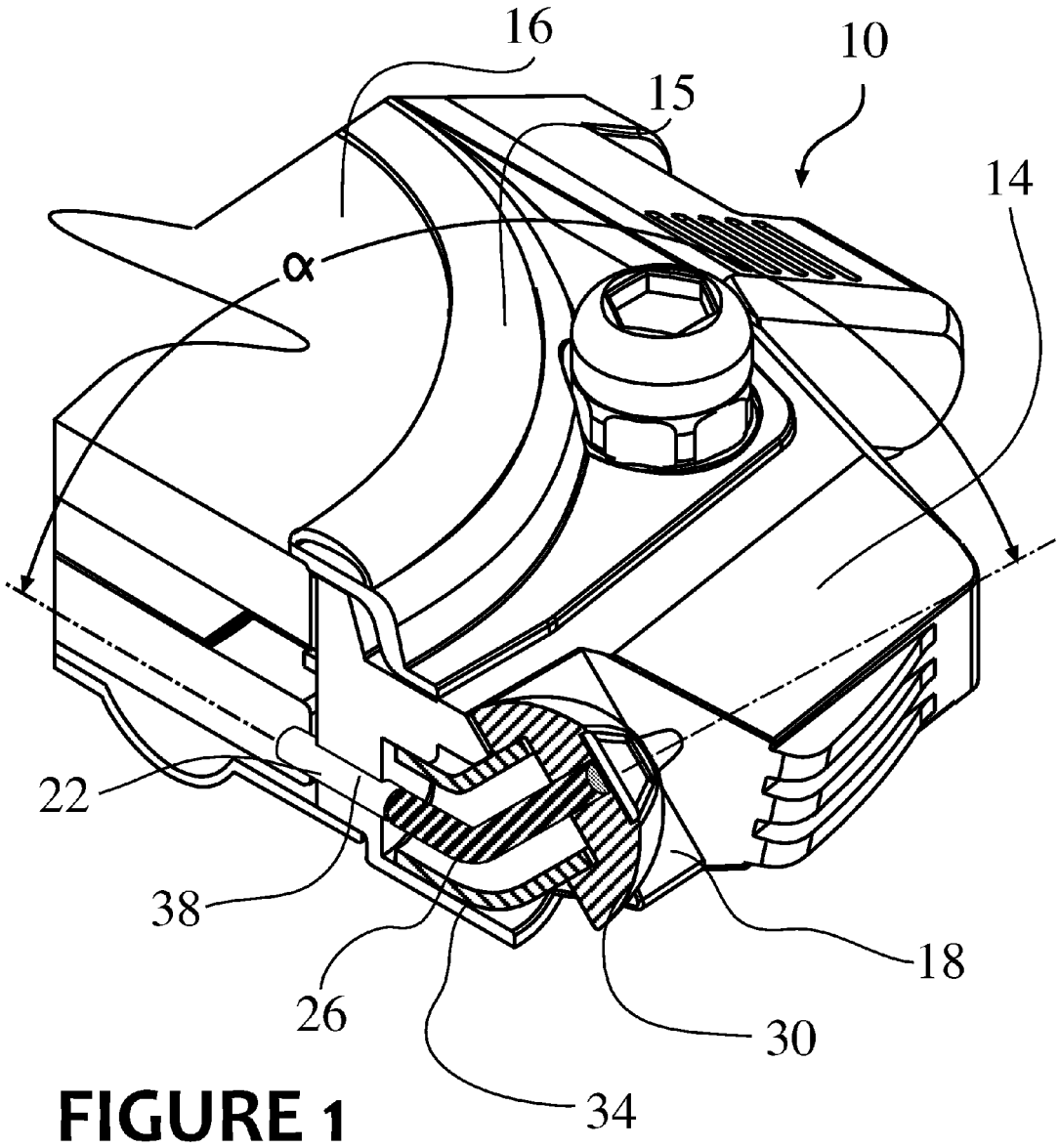
FIG. 1 is sectional view of a flexible shaft embodiment of the disclosed angled crown setting device.

FIG. 1 shows a perspective view of a timepiece 10. The timepiece comprises a case 14 and a crown setting device 18. FIG. 1 also shows a bezel 15 and a crystal (or glass, or any other suitable material for displaying the time and protecting the timepiece movement) 16. The crown setting device 18 comprises a setting stem 22. The setting stem is in communication with a flexible shaft 26. The flexible shaft may be made out of any suitable material, including but not limited to: woven steel mesh, flexible plastic of appropriate durometer, rubber and plastic combinations, and combinations of woven steel mesh and rubber/plastic material. The flexible shaft 26 has an angle $\alpha$. The angle $\alpha$ may range from about 90° to about 175°. In the embodiment shown the angle $\alpha$ is about 135°. The flexible shaft 26 is attached to a crown 30. The crown 30 is attached to a crown barrel 34, the crown barrel 34 is slideably engaged with the case 14. A setting stem seal 38 may be located in the case 14 and about the setting stem 22, in order to prevent contaminants from entering the timepiece movement, or in other words from entering the interior of the case from the barrel and crown side of the case. In this disclosure, the phrase crown shaft shall refer to the entire flexible shaft and the portion of the shaft that is parallel to the setting stem, and to the portion of the shaft that is at an angle $\alpha$ to the setting stem.

Figure 2:
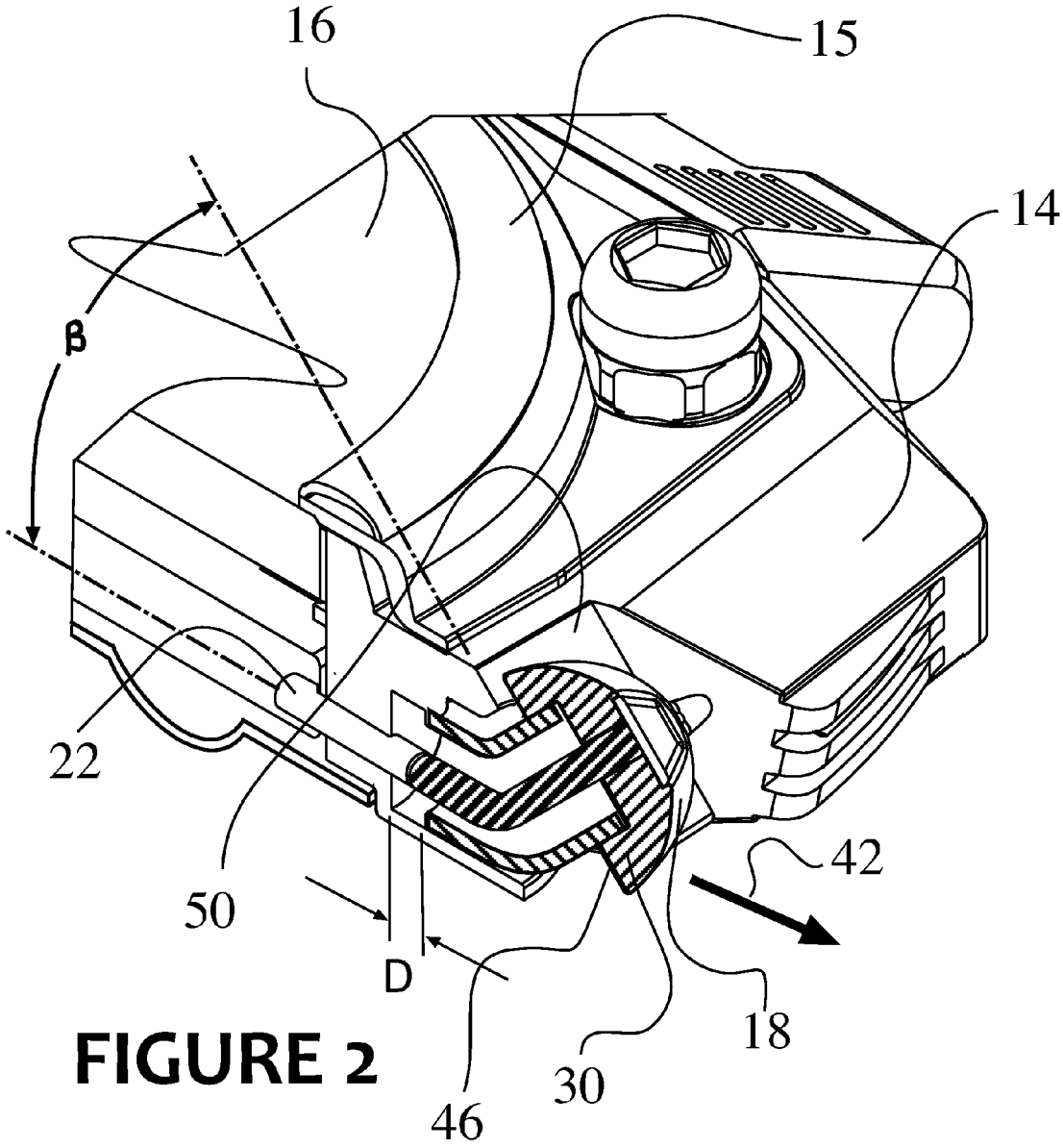
FIG. 2 is a sectional view of the angled crown setting device of FIG. 1, with the crown pulled out a certain distance from the case.

FIG. 2 shows the timepiece 10 from FIG. 1, however in this view the flexible shaft 26, crown 30, and crown barrel 34 has been moved to the right in the direction of the arrow 42 with respect to the case 14. The direction of the movement, as shown by arrow 42, is generally parallel to the bezel 15 and/or the crystal 16. Thus, as the crown 30 moves away from the case 14, a user will have more room to grip or touch the crown with his or her fingers and turn the crown in order to adjust the time, date, and or alarm. When the user rotates the crown, the flexible shaft 26 rotates, which in turns rotates the setting stem 22. The amount of movement in the direction of the arrow 42 can be associated with one or more positions. For example, in one embodiment a first position would allow one to change the date by rotating the crown, and a second position would allow one to change the time by rotating the crown. The amount of movement in the direction 42 is shown by D, and may be range from about 1 mm to about 3 mm, and preferably be about 1 mm for a first position, and about 2 mm for a second position.

It should be noted that the crown 30 has a bottom surface 46 that is generally planar. In addition, case 14 has an angled surface 50, that is at an angle β, where angle β is generally supplementary to angle α. This configuration of angles α and β, allows the bottom surface 46 to be generally parallel to angled surface 50. Also, the angled surface 50 of the case 14, has a section removed that is generally adjacent to the portion of the crown bottom surface 46 of the crown 30 that extends past the barrel (see FIG. 4). In another embodiment, the angled surface 50 may not extend generally past the crown barrel 34, see FIG. 3.

Figure 3:
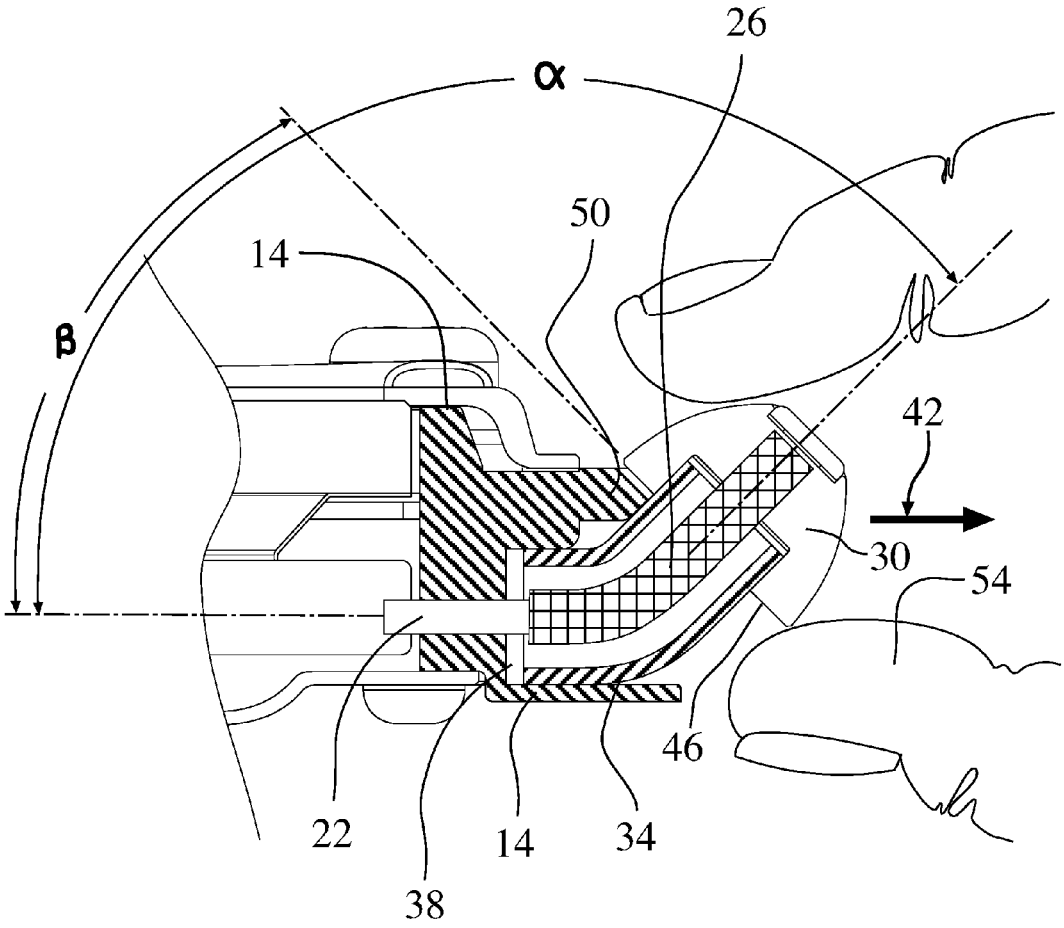
FIG. 3 is a close-up side sectional view of the angled crown setting device from FIG. 1.

FIG. 3 is a cross-sectional view of the timepiece 10 from FIG. 1. In FIG. 3 it can be seen that a user's finger 54 has room to pull the crown 30 in the direction of the arrow 42, by pulling out on the crown bottom surface 46, due to the space made by the angled surface 50 not extending past the barrel 34, or in another embodiment, by their being a cutout of the angled surface generally adjacent to that portion of crown bottom surface 46 that extends below the barrel 34. With the crown 30 extended away from the case 14, it will be easy for the user to adjust the time, date, alarm, or any other settings of the timepiece 10 by rotating the crown 30 about its axis. When done adjusting the time, date, alarm, or any other settings, the user can simply push the crown back into the case 14.

Figure 4:
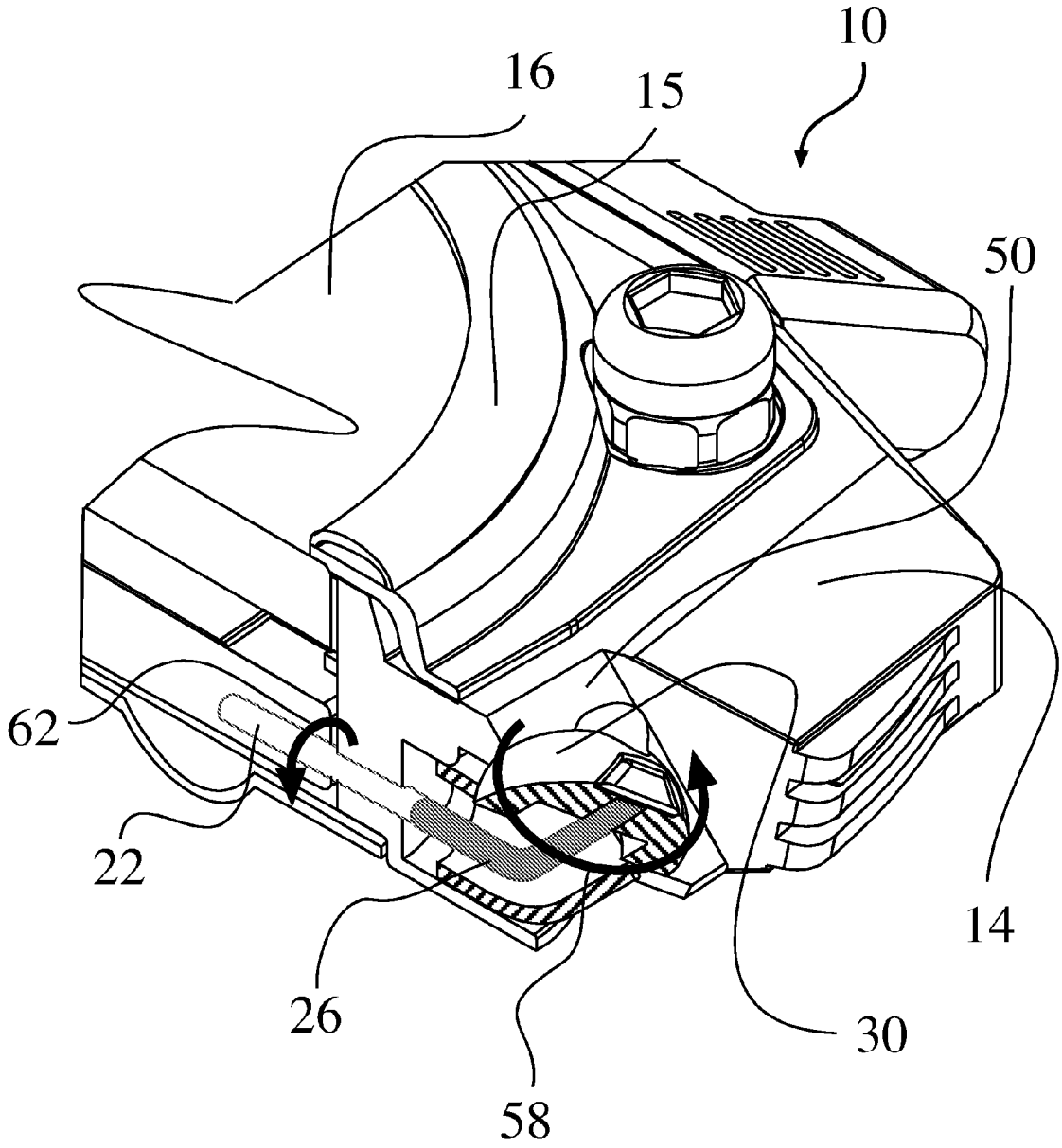
FIG. 4 is a sectional view of the angled crown setting device of FIG. 2, illustrating the rotation of the crown and the setting stem.

FIG. 4 shows a partial cross-sectional view of the time piece from FIG. 2. In this figure, it can be seen that when the crown is rotated in a counter-clockwise direction as shown by the arrow 58 the flexible shaft 26 also rotates in a generally counter-clockwise direction as shown by the arrow 62 when looking from the crown 30 down the shaft 26. Similarly, if the crown is rotated in a clockwise direction, then the flexible shaft 26 will also rotate in a clockwise direction when looking from the crown 30 down the shaft 26.

Figure 5:
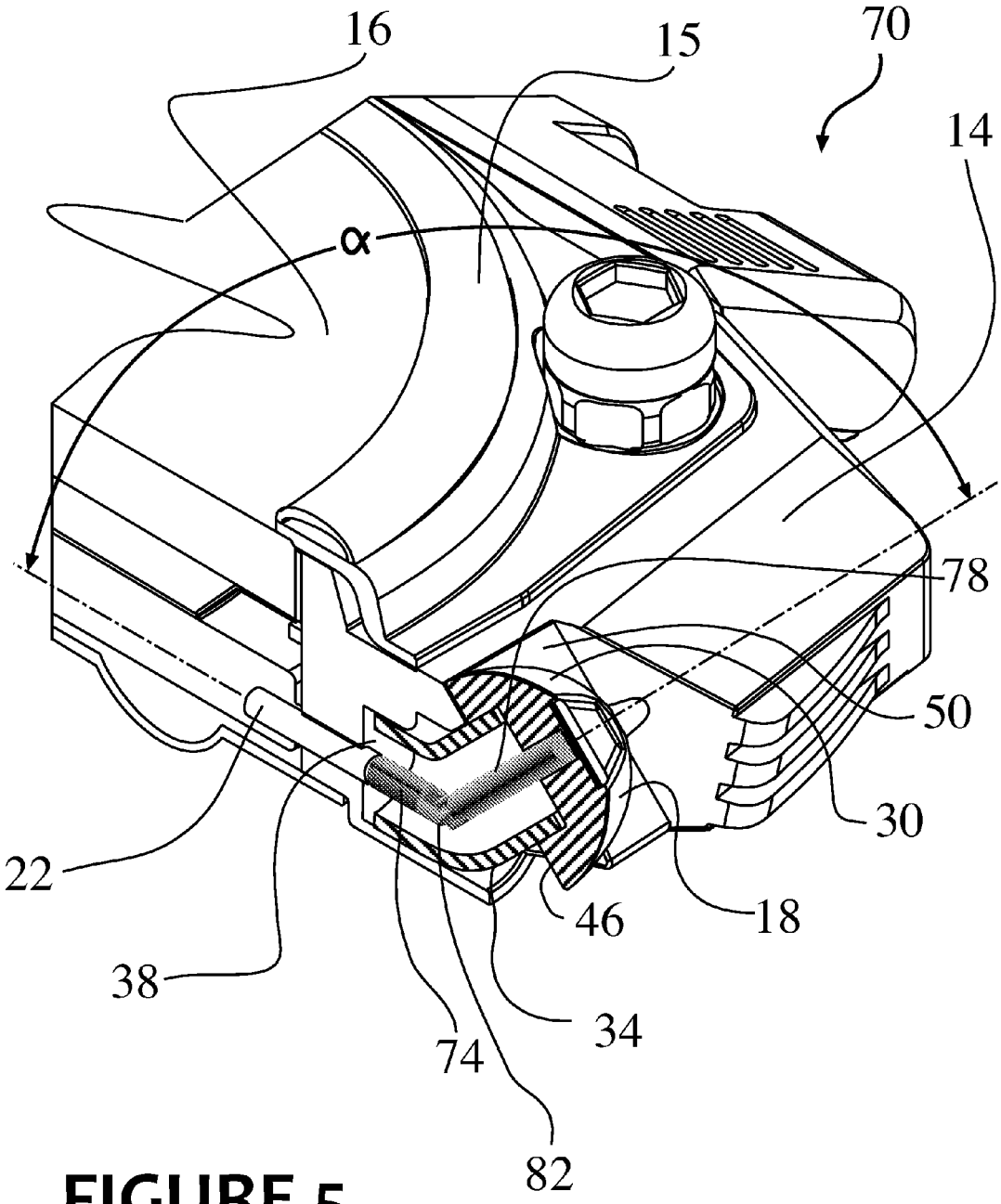
FIG. 5 is a sectional view of a universal joint embodiment of the disclosed angled crown setting device.

FIG. 5 shows another embodiment of the disclosed timepiece 70. In this embodiment, the flexible shaft 26 as disclosed in FIGS. 1-4, is replaced by two generally inflexible shafts connected by a universal joint connector. The timepiece 70 comprises a case 14 and a crown setting device 18. The timepiece 70 also comprises a bezel 15 and a crystal (or glass, or any other suitable material for displaying the time and protecting the timepiece movement) 16. The crown setting device 18 comprises a setting stem 22. The setting stem is in communication with a first generally inflexible shaft 74. A second generally inflexible shaft 78 is attached to a crown 30. A universal joint connector 82 connects the first generally inflexible shaft 74 to the second generally inflexible shaft 78. Thus, when the crown 30 is rotated, it causes the second generally inflexible shaft 78 to rotate, and even though the first generally inflexible shaft 74 is at an angle α with respect to the second generally inflexible shaft 78, the first generally inflexible shaft will rotate also. The crown 30 is attached to a crown barrel 34, the crown barrel 34 is slideably engaged with the case 14. A setting stem seal 38 may be located in the case 14 and about the setting stem 22, in order to prevent contaminants from entering the timepiece movement.

Figure 6:
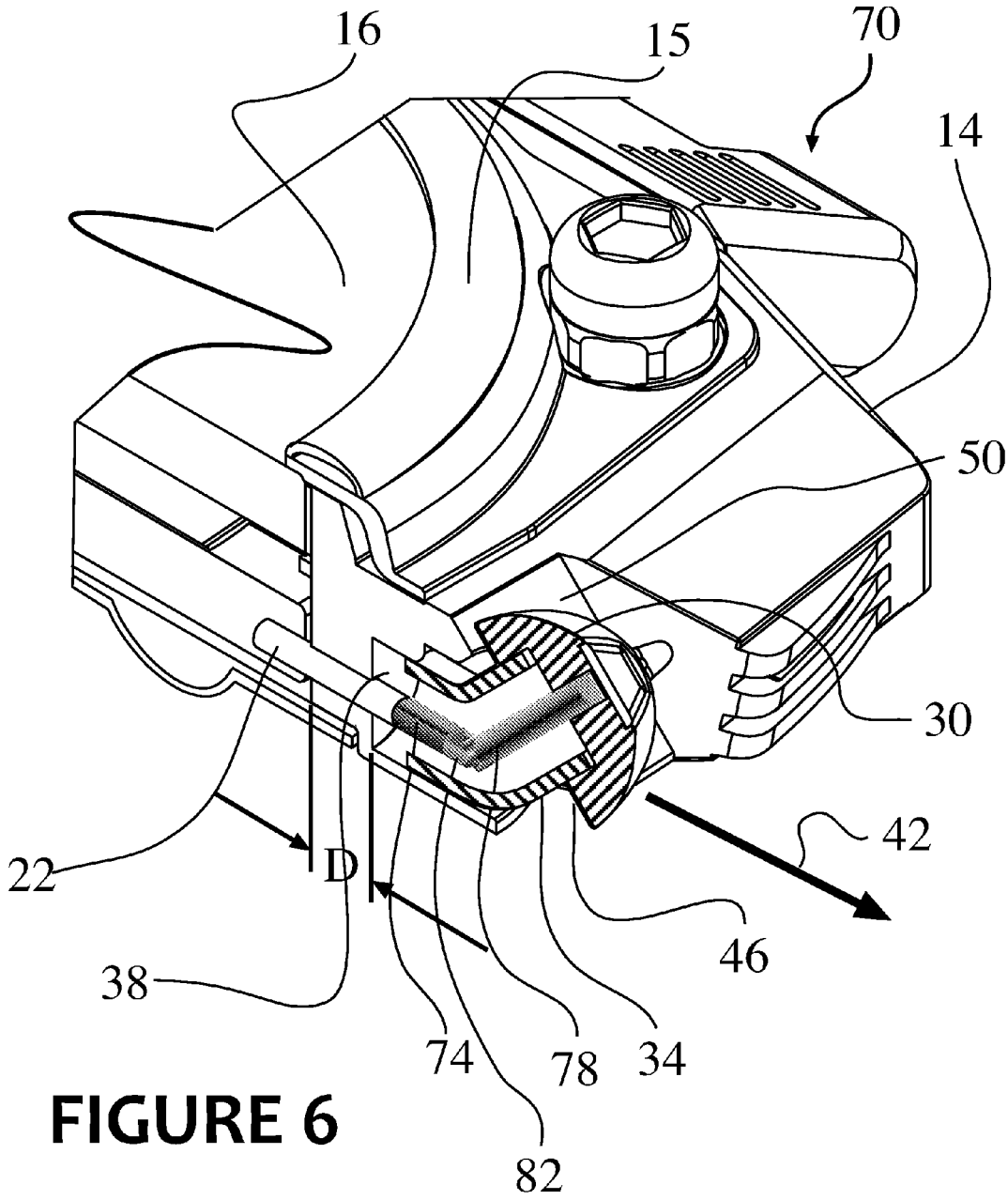
FIG. 6 is a sectional view of the disclosed angled crown setting device from FIG. 5, with the crown pulled out a certain distance from the case.
Figure 7:
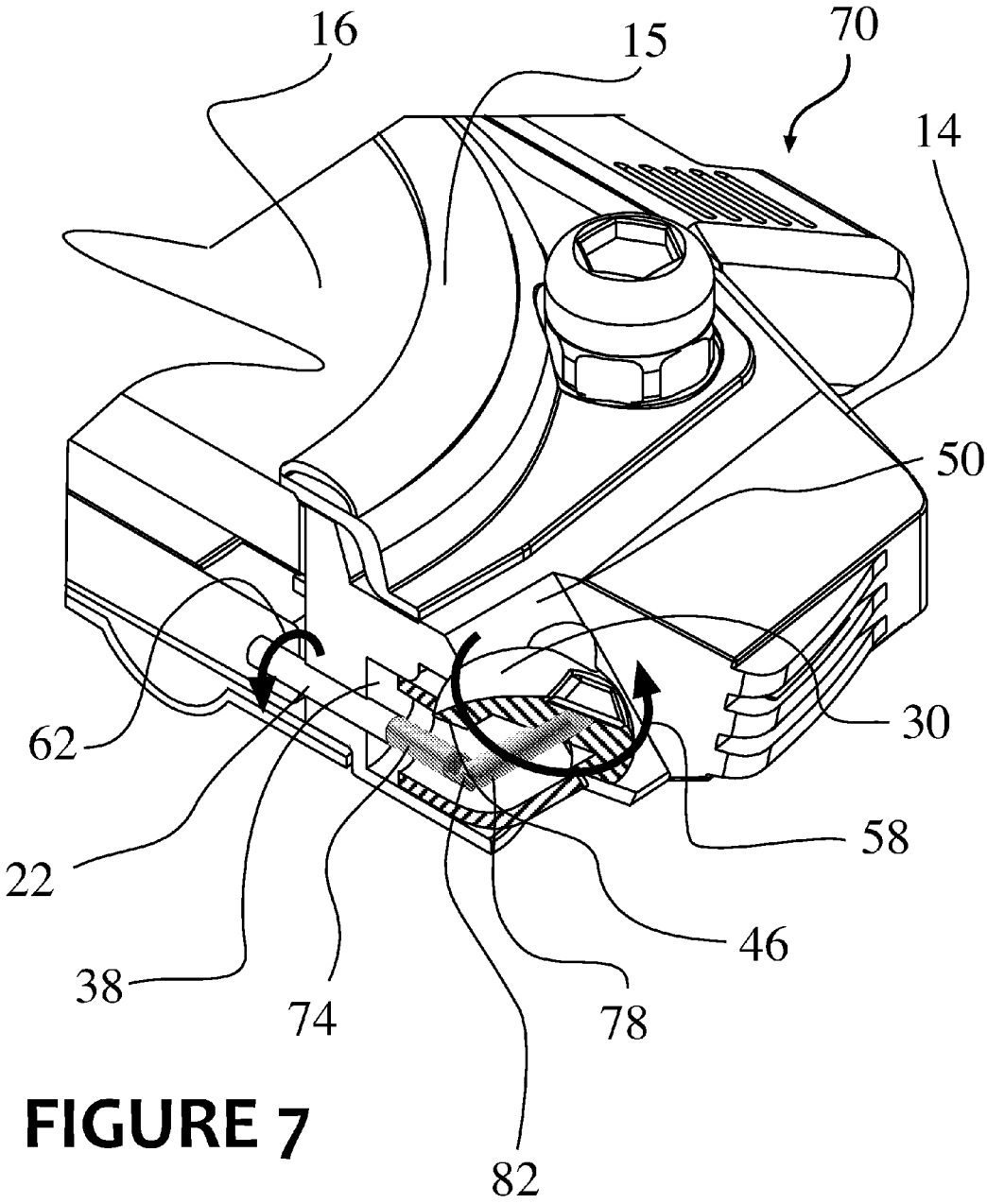
FIG. 7 is a sectional view of the angled crown setting device of FIG. 6, illustrating the rotation of the crown and the setting stem.

FIG. 6 shows the timepiece 70 from FIG. 5, however in this view the two generally inflexible shafts 74, 78, universal joint connector 82, crown 30, and crown barrel 34 has been moved to the right in the direction of the arrow 42 with respect to the case 14. The direction of the movement, as shown by arrow 42, is generally parallel to the bezel 15 and/or the crystal 16. Thus, as the crown 30 moves away from the case 14, a user will have more room to grip or touch the crown 30 with his or her fingers and turn the crown 30 in order to adjust the time, date, and or alarm. When the user rotates the crown, the two generally inflexible shafts 74, 78, universal joint connector 82 rotate, which in turns rotates the setting stem 22, see FIG. 7. The amount of movement in the direction of the arrow 42 can be associated with one or more positions. For example, in one embodiment a first position would allow one to change the date by rotating the crown, and a second position would allow one to change the time by rotating the crown. The amount of movement in the direction 42 is shown by D, and may be range from about 1 mm to about 3 mm, and preferably by about 1 mm for a first position, and about 2 mm for a second position. In this disclosure, the phrase crown shaft shall also refer to the two generally inflexible shafts 74, 78, and universal joint connector 82.

As similarly discussed with respect to FIGS. 1 and 2 above, it should be noted that the crown 30 has a bottom surface 46 that is generally planar. In addition, case 14 has an angled surface 50, that is at an angle β, where angle β is generally supplementary to angle α. This configuration of angles α and β, allows the bottom surface 46 to be generally parallel to angled surface 50. Also, the angled surface 50 of the case 14, has a section removed that is generally adjacent to the portion of the crown bottom surface 46 of the crown 30 that extends past the barrel. In another embodiment, the angled surface 50 may not extend generally past the crown barrel 34.

Figure 8:
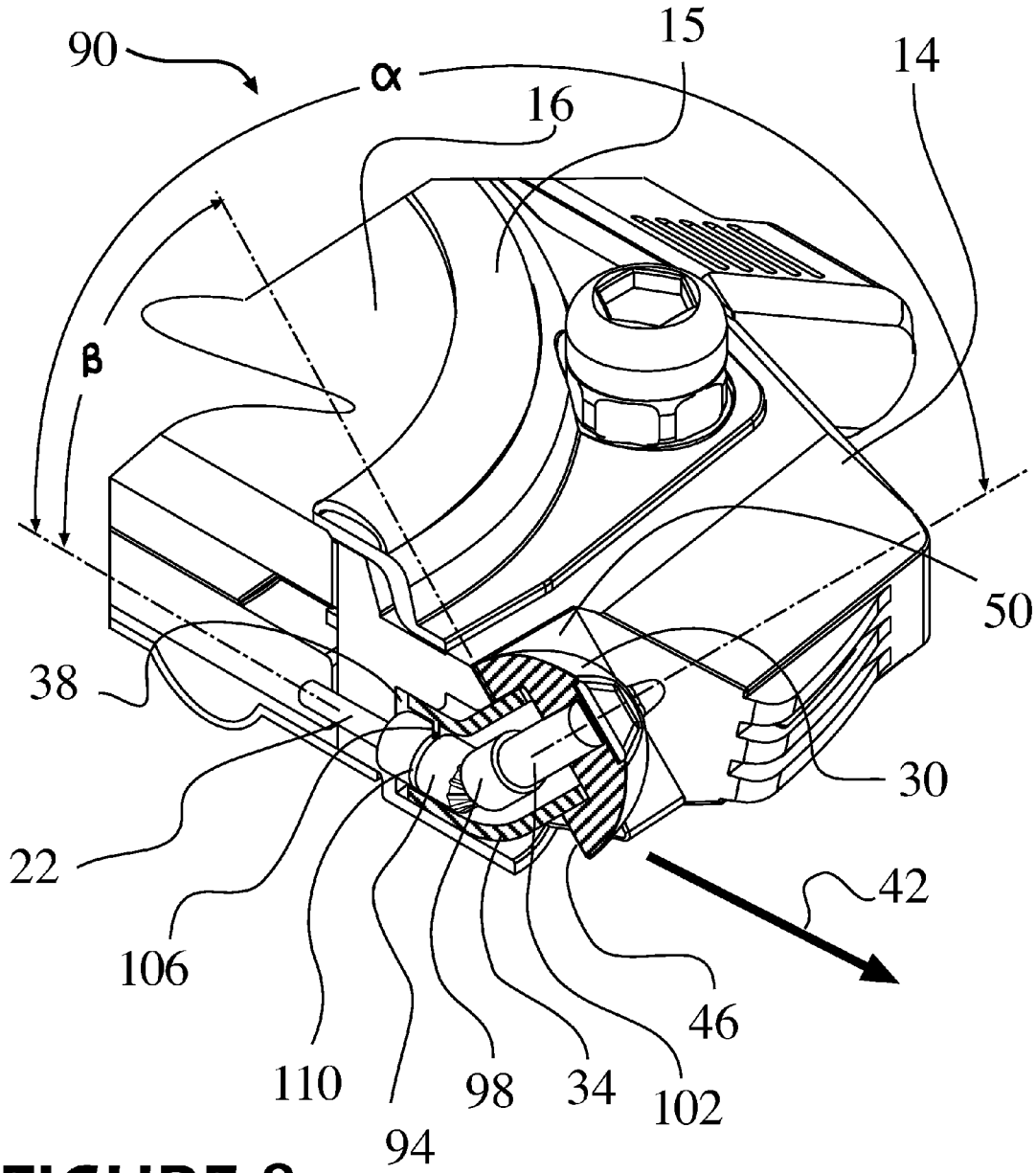
FIG. 8 is a sectional view of a angled gear embodiment of the disclosed angled crown setting device.

FIG. 8 shows another embodiment of the disclosed timepiece 90. In this embodiment, a first angled gear 94 is in communication with the setting stem 22. The gear 94 meshes with a second angled gear 98. The second angled gear is in communication with an angled shaft 102, and the angled shaft 102 is in fixed communication with the crown 30. In this embodiment, the interior of the crown barrel 34 has a positioning member 106. The positioning member 106 is configured to fit in a slot 110 located in the body of the first angled gear 98. Thus, when the crown 30 is pulled out in the direction of the arrow 42, the angled shaft 102 and crown barrel 34 also moves in the direction in the arrow 42, and because the positioning member 106 is attached to the barrel 34, and is also in communication with the slot 110, the positioning member 106 pulls the first angled gear 94 and the setting stem 22 in the direction of the arrow 42. In other embodiments, the slot 110 may be located directly in the setting stem, with the positioning member 106 configured to fit in the slot. The crown 30 is attached to a crown barrel 34, the crown barrel 34 is slideably engaged with the case 14. A setting stem seal 38 may be located in the case 14 and about the setting stem 22 in order to prevent contaminants from entering the timepiece movement. In this disclosure, the phrase crown shaft shall also refer to the first angled gear 94, the second angled gear 98, and the angled shaft 102. The angled shaft 102 is at an angle α with respect to the setting stem 22.

Figure 9:
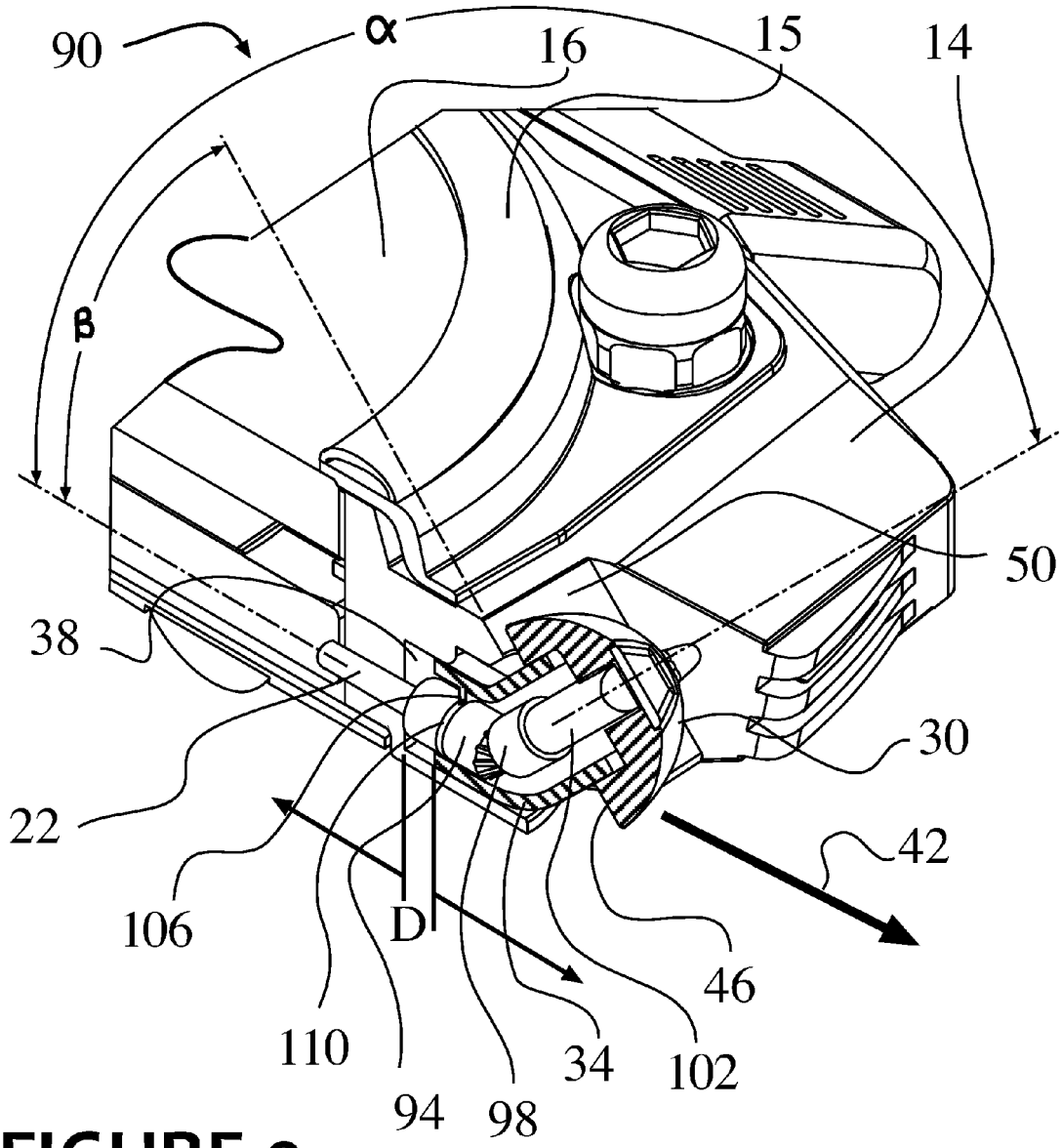
FIG. 9 is a sectional view of the disclosed angled crown setting device from FIG. 8, with the crown pulled out a certain distance from the case.

FIG. 9 shows the timepiece 90 from FIG. 8, however in this view the two angled gears 94, 98, crown barrel 34, setting stem 22 and crown have been moved to the right in the direction of the arrow 42 with respect to the case 14. The direction of the movement, as shown by arrow 42, is generally parallel to the bezel 15 and/or the crystal 16. Thus, as the crown 30 moves away from the case 14, a user will have more room to grip or touch the crown 30 with his or her fingers and turn the crown 30 in order to adjust the time, date, and or alarm. When the user rotates the crown, the angled shaft 102, two angled gears 94, 98 rotate, which in turn rotates the setting stem 22. The amount of movement in the direction of the arrow 42 can be associated with one or more positions. For example, in one embodiment a first position would allow one to change the date by rotating the crown, and a second position would allow one to change the time by rotating the crown. The amount of movement in the direction 42 is shown by D, and may be range from about 1 mm to about 3 mm, and preferably by about 1 mm for a first position, and about 2 mm for a second position.

As similarly discussed with other embodiments above, it should be noted that the crown 30 has a bottom surface 46 that is generally planar. In addition, case 14 has an angled surface 50, that is at an angle β, where angle β is generally supplementary to angle α. This configuration of angles α and β, allows the bottom surface 46 to be generally parallel to angled surface 50. Also, the angled surface 50 of the case 14, has a section removed that is generally adjacent to the portion of the crown bottom surface 46 of the crown 30 that extends past the barrel. In another embodiment, the angled surface 50 may not extend generally past the crown barrel 34.

Figure 10:
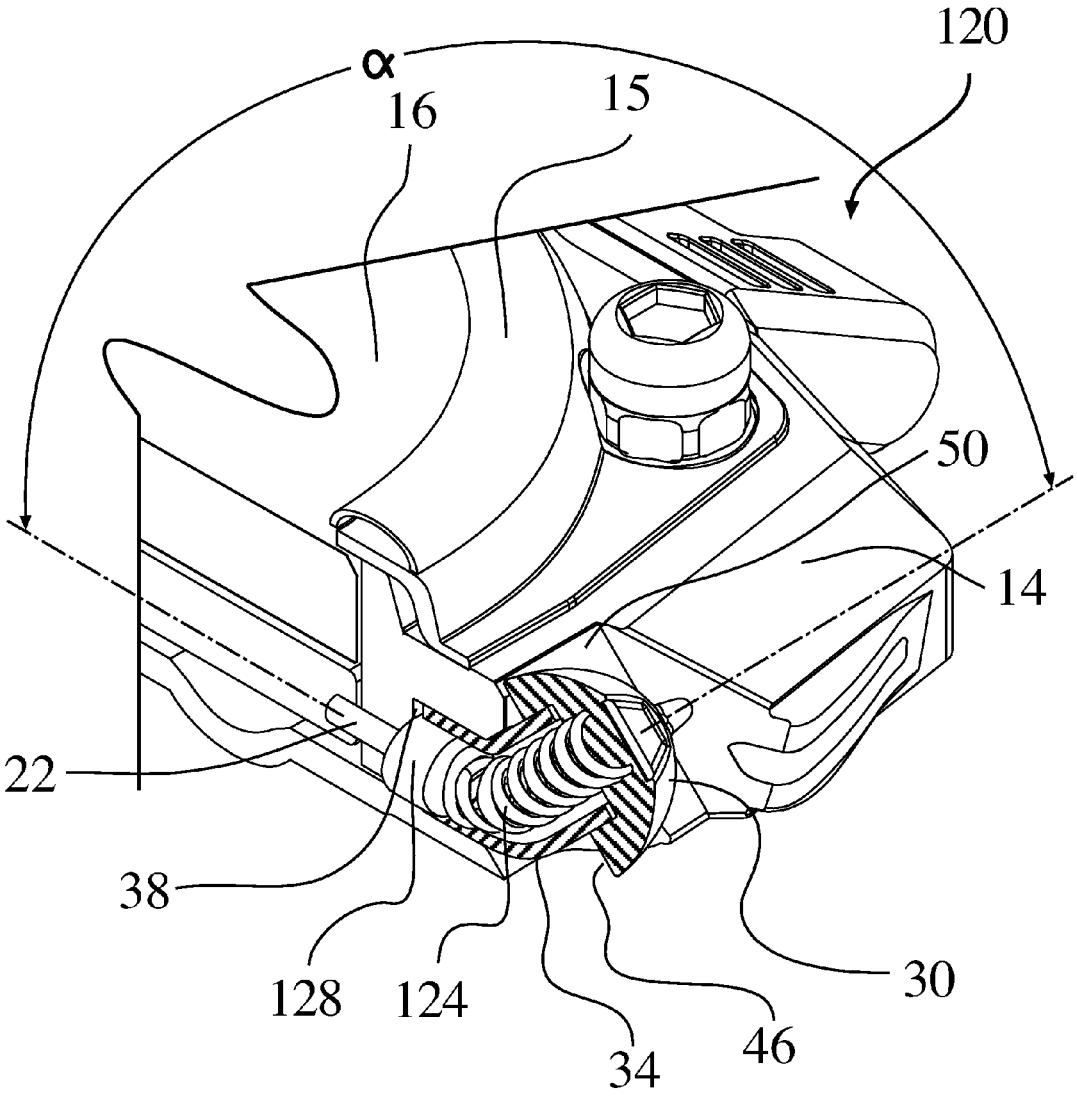
FIG. 10 is a sectional view of a spring embodiment of the disclosed angled crown setting device.

FIG. 10 shows another embodiment of the disclosed timepiece 120. In this embodiment, a spring 124 is in communication with a spring base 128. The spring base is in communication with the setting stem 22. The spring 124 is also in fixed communication with the crown 30. The crown 30 is attached to a crown barrel 34, the crown barrel 34 is slideably engaged with the case 14. A setting stem seal 38 may be located in the case 14 and about the setting stem 22 in order to prevent contaminants from entering the timepiece movement. In this disclosure, the phrase crown shaft shall also refer to the spring 124, and the spring base 128. The spring allows the crown 30 to be at an angle α with respect to the setting stem 22. The use of the spring 124 allows the crown 30 to be angled with respect to the setting stem 22.

Figure 11:
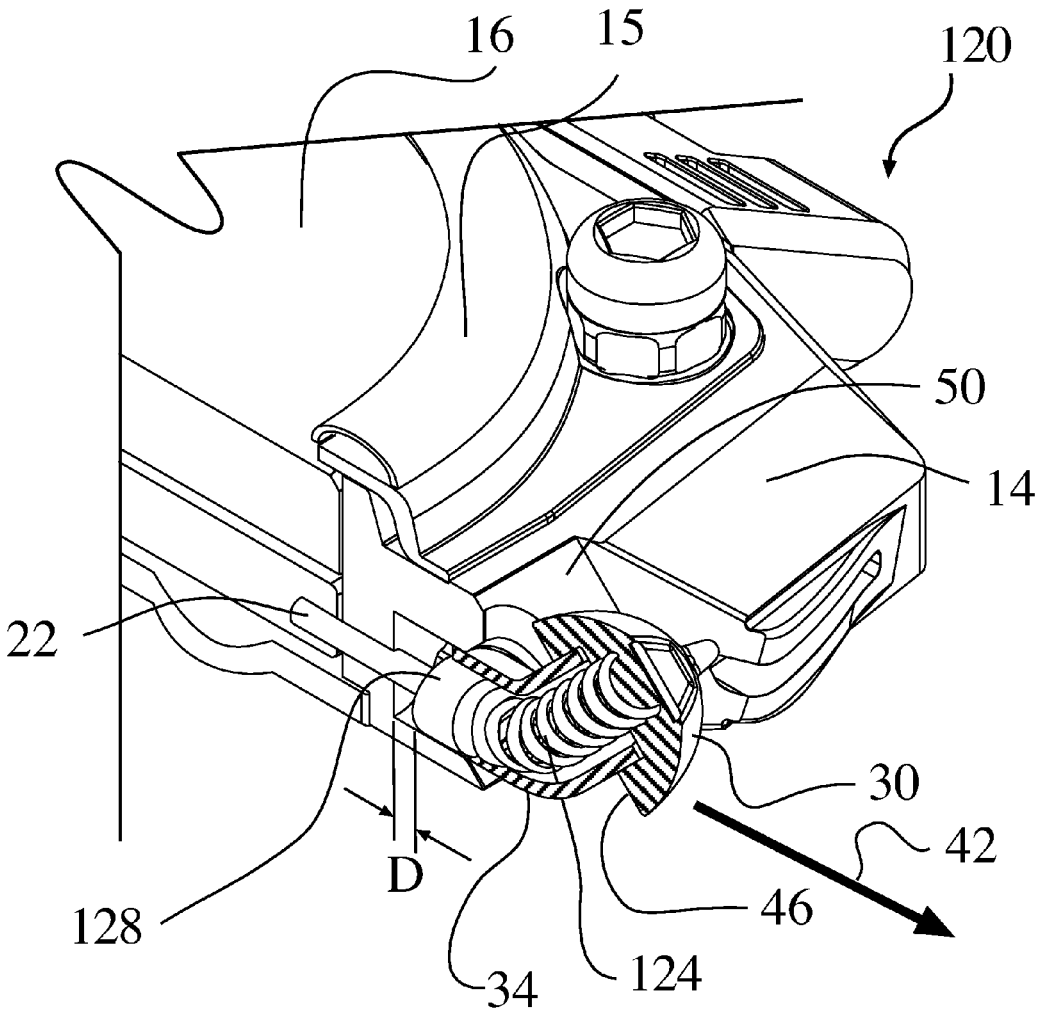
FIG. 11 is a sectional view of the spring embodiment of the disclosed angled crown setting device from FIG. 10, with the crown pulled out a certain distance from the case.

FIG. 11 shows the timepiece 120 from FIG. 10; however in this view the spring 124, spring base 128, setting stem 22 and crown have been moved to the right in the direction of the arrow 42 with respect to the case 14. The direction of the movement, as shown by arrow 42, is generally parallel to the bezel 15 and/or the crystal 16. Thus, as the crown 30 moves away from the case 14, a user will have more room to grip or touch the crown 30 with his or her fingers and turn the crown 30 in order to adjust the time, date, and or alarm. When the user rotates the crown, the spring 124 and spring base 128 rotate, which in turn rotates the setting stem 22. The amount of movement in the direction of the arrow 42 can be associated with one or more positions. For example, in one embodiment a first position would allow one to change the date by rotating the crown, and a second position would allow one to change the time by rotating the crown. The amount of movement in the direction 42 is shown by D, and may be range from about a 1 mm to about 3 mm, and preferably by about 1 mm for a first position, and about 2 mm for a second position.

As similarly discussed with other embodiments above, it should be noted that the crown 30 has a bottom surface 46 that is generally planar. In addition, case 14 has an angled surface 50, that is at an angle β, where angle β is generally supplementary to angle α. This configuration of angles α and β, allows the bottom surface 46 to be generally parallel to angled surface 50. Also, the angled surface 50 of the case 14, has a section removed that is generally adjacent to the portion of the crown bottom surface 46 of the crown 30 that extends past the barrel. In another embodiment, the angled surface 50 may not extend generally past the crown barrel 34.

Figure 12:
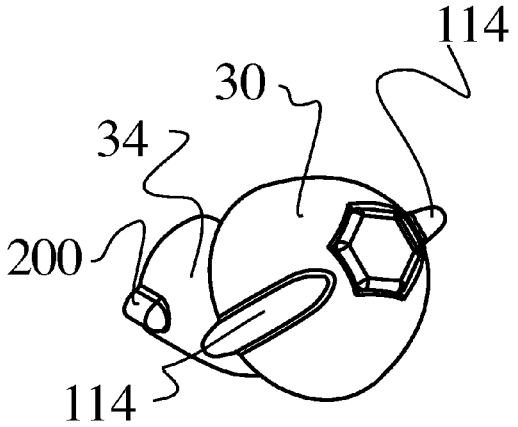
FIG. 12 is a perspective view of one embodiment of the crown.
Figure 13:
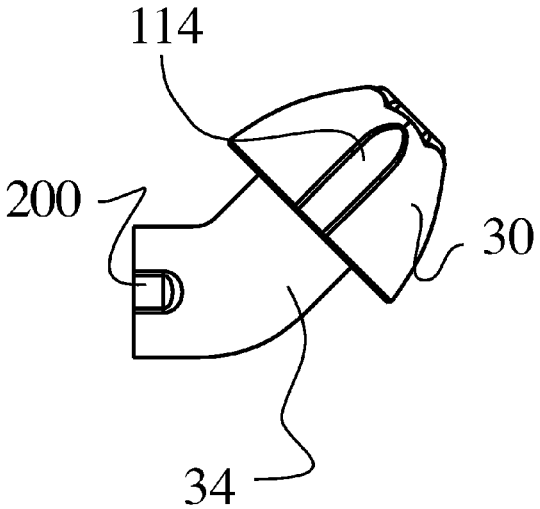
FIG. 13 is a side view of the crown from FIG. 10.

FIG. 12 shows a detailed perspective view of one embodiment of the crown 30. In this view it can be seen that the crown has a generally paraboloid shape. In particular, one embodiment of the crown 30, has one or more fins 114 extending generally orthogonally from the crown. FIG. 13 is a side view of the crown 30 and barrel 34 from FIG. 10. The fins 114 may assist a user in rotating the crown 30 when setting the time, date, alarm, or any other settings of the timepiece. In another embodiment, the crown may omit the fins 114. In addition, the barrel 34 may have rib members 200 located on the barrel's outer surface. The rib members 200 are configured to be slideably engaged with slots on the case 14. This allows the barrel 34 to be slideably moveable with respect to the case 14, but prevents the barrel 34 from rotating with respect to the case 14.

The disclosed invention has many advantages. It allows a wearer of the timepiece to easily pull the crown out a certain distance, in order to adjust the time, date, alarm, or any other settings of the timepiece without necessarily removing the timepiece from a wearer's wrist. The bottom surface of the crown is easily accessible to the wearer, and the wearer can simply pull up on the bottom surface of the crown in order to move the crown to a first or a second position for adjustment of the timepiece. The crown is designed to allow for easy rotation by the wear, due to its shape and/or the presence of the fins.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A crown setting device for a timepiece comprising:
- a case;
- a bezel attached to the case;
- a setting stem in axially slideable communication with the case;
- a crown shaft, the crown shaft comprising:
  - a first end;
  - a second end;
  - a first portion of the crown shaft abutting the first end;
  - a second portion of the crown shaft abutting the second end; and wherein the first end is in fixed communication with the setting stem;
- a crown in fixed communication with the second end;
- a crown barrel in rotatable communication with the crown and in slideable and non-rotatable communication with the case;
- a first angled gear fixedly attached to the first portion;
- a second angled gear fixedly attached to the second portion; and
- wherein the first angled gear meshes with the second angled gear; and wherein the second portion is at an angle α with respect to the first portion, and wherein the angle α is between about 90° and about 175°.

2. The crown setting device of claim 1, further comprising:
- a positioning member extending from the interior surface of the crown barrel;
- a slot located in the body of the first angled gear; and wherein the positioning member is configured to fit in the slot, and cause the first angled gear to move axially with the crown barrel.

3. A crown setting device for a timepiece comprising:

a case;

a bezel attached to the case;

a setting stem in axially slideable communication with the case;

a crown shaft, the crown shaft comprising:

a first end;

a second end;

a first portion of the crown shaft abutting the first end;

a second portion of the crown shaft abutting the second end; and wherein the first end is in fixed communication with the setting stem;

a crown in fixed communication with the second end;

a crown barrel in rotatable communication with the crown and in slideable and non-rotatable communication with the case;

a bottom surface of the crown that is generally planar;

an angled case surface that is generally adjacent to the bottom surface of the crown, and the angled case surface has an angle $\beta$ that is generally supplementary to angle $\alpha$; and wherein the second portion is at an angle $\alpha$ with respect to the first portion, and wherein the angle $\alpha$ is between about 90° and about 175°.

4. The crown setting device of claim 3, wherein the angled case surface has a section removed that is generally adjacent to the portion of the bottom surface of the crown that extends past the barrel.

5. The crown setting device of claim 3, wherein the angled case surface does not extend generally past the crown barrel.

* * * * *